US012441513B2

(12) United States Patent
Diebold et al.

(10) Patent No.: US 12,441,513 B2
(45) Date of Patent: Oct. 14, 2025

(54) FOLDABLE TRANSPORT CONTAINER

(71) Applicant: HEY CIRCLE GMBH, Munich (DE)

(72) Inventors: Doris Diebold, Munich (DE); Christian Krawczyk, Munich (DE); Nadja Sommer, Bargau (DE); Felix Boettcher, Gross-Gerau (DE)

(73) Assignee: HEY CIRCLE GMBH, Munich (DE)

( * ) Notice: Subject to any disclaimer, the term of this patent is extended or adjusted under 35 U.S.C. 154(b) by 24 days.

(21) Appl. No.: 18/564,847

(22) PCT Filed: May 18, 2022

(86) PCT No.: PCT/EP2022/063448
§ 371 (c)(1),
(2) Date: Nov. 28, 2023

(87) PCT Pub. No.: WO2022/248308
PCT Pub. Date: Dec. 1, 2022

(65) Prior Publication Data

US 2024/0383644 A1 Nov. 21, 2024

(30) Foreign Application Priority Data

May 28, 2021 (LU) ..... LU500217

(51) Int. Cl.
*B65D 21/08* (2006.01)
*A45C 7/00* (2006.01)
(Continued)

(52) U.S. Cl.
CPC ..... *B65D 21/086* (2013.01); *A45C 7/0036* (2013.01); *A45C 13/103* (2013.01); *B65D 43/161* (2013.01); *B65D 43/22* (2013.01)

(58) Field of Classification Search
CPC .... B65D 21/086; B65D 43/161; B65D 43/22; B65D 11/186; B65D 1/225; A45C 7/0036; A45C 13/103
(Continued)

(56) References Cited

U.S. PATENT DOCUMENTS 2,250,126 A * 7/1941 Walter ..... A45C 7/0036 190/107
7,175,010 B1 * 2/2007 Miner ..... A45C 7/0036 190/902
(Continued)

FOREIGN PATENT DOCUMENTS

DE 377453 C 6/1923
DE 1040448 B 10/1958
(Continued)

OTHER PUBLICATIONS

International Search Report (with translation) and Written Opinion for PCT/EP2022/063448, mailed on Sep. 27, 2022.

*Primary Examiner* — Ernesto A Grano
(74) *Attorney, Agent, or Firm* — Dennemeyer & Associates LLC

(57) ABSTRACT

The invention relates to a foldable transport container (10), which can be moved between an unfolded transport position and a folded position, with a base (12), a lid (16), a side wall (14*a*) carrying the lid (16) and three further side walls (14), wherein the lid (16) is pivotably connected to the supporting side wall (14*a*) about a pivot axis, characterised in that interlocking or engageable closure means (30) for fixing the transport container (10) in the folded position have corresponding first and second closure elements (32, 34), which are designed to be brought into engagement with one another in the folded position, wherein at least one first closure element (32) is arranged in the region of the lid (16)
(Continued)

and at least one second closure element (34) is arranged in the region of a lower base edge (18) of the further side walls (14).

14 Claims, 5 Drawing Sheets

(51) Int. Cl.
*A45C 13/10* (2006.01)
*B65D 43/16* (2006.01)
*B65D 43/22* (2006.01)

(58) Field of Classification Search
USPC ..... 206/216
See application file for complete search history.

(56) References Cited

U.S. PATENT DOCUMENTS 8,225,934 B1 * 7/2012 Malcolm ..... A45C 11/20 206/541
9,527,626 B1 * 12/2016 Coronado ..... B65D 11/186
11,866,225 B2 * 1/2024 Schafer ..... B65D 33/004
12,114,749 B1 * 10/2024 Schinasi ..... A45C 5/143
2005/0034948 A1 * 2/2005 Tiramani ..... A45C 7/0022 190/127
2005/0157960 A1 * 7/2005 Godshaw ..... A45C 7/0036 383/121.1
2006/0056743 A1 * 3/2006 Kobetsky ..... B65D 33/2541 24/399
2006/0219723 A1 * 10/2006 Wang ..... B65D 81/052 220/592.27
2007/0012593 A1 * 1/2007 Kitchens ..... A45C 7/0036 206/545
2011/0210019 A1 * 9/2011 Sempe ..... A45C 7/0036 206/6
2012/0018330 A1 * 1/2012 Kato ..... A45C 7/0036 206/372
2013/0056373 A1 * 3/2013 Benson ..... A45C 7/0077 206/278
2015/0344170 A1 * 12/2015 Schneider ..... B65D 43/14 220/4.28
2019/0166991 A1 * 6/2019 Sawachi ..... A45C 7/0036
2023/0211919 A1 * 7/2023 Kennedy ..... B65D 11/1893 220/4.28

FOREIGN PATENT DOCUMENTS

GB 896843 A 5/1962
WO 2017064739 A1 4/2017

* cited by examiner

FOLDABLE TRANSPORT CONTAINER

The invention relates to a foldable transport container, which can be moved between an unfolded transport position and a folded position, comprising a base, a lid, a side wall supporting the lid and three further side walls, wherein the lid is pivotably connected to the supporting side wall about a pivot axis.

Transport containers or transport packaging are well known from the fields of transport, logistics, shipping, as well as from everyday life. Transport crates or boxes for postal shipping are often made of cardboard and are typically purchased in a collapsed or folded-up state. Before use, the user must manually transfer the transport box or carton to an unfolded or folded-out state, which enables the transport packaging to be loaded. Such transport packaging often has folding mechanisms that are not designed to be reversible, i.e. it is often not possible to fold the transport packaging after use without causing damage, nor is it usually possible to return it empty. The reuse of such transport packaging is therefore only possible to a very limited extent in practice, which is at odds with the concept of sustainability. Storing transport packaging, crates or boxes in an unfolded state until they are reused requires a lot of space, therefore such an approach is generally impractical. Returning the container empty and in a space-saving manner is only possible if it is closed when in the folded state.

Containers for household items, such as those described in DE 44 43 334 A1, usually have relatively complicated internal structures and mechanisms, for example in the manner of a scissor frame, which provide the folding function. Such containers are comparatively complex and expensive to produce and are therefore not suitable for use in the field of logistics or transport.

A reusable, collapsible ballot box is known from EP 0 542 821.

FR 1.315.104 describes a collapsible suitcase.

U.S. Pat. No. 10,279,981 B2 discloses a transport crate with a zipper that runs between a lid and a base of the transport crate.

It is the technical object of the invention to provide a transport container of a simple design, which can be moved between an unfolded transport position and a folded position, requires a small amount of storage space and is designed or suitable for repeated use.

The invention relates to a foldable transport container, which can be moved between an unfolded transport position and a folded position, with a base, a lid, a side wall carrying the lid and three further side walls, wherein the lid is pivotably connected to the supporting side wall about a pivot axis, characterised in that interlocking or engageable closure means for fixing the transport container in the folded position have corresponding first and second closure elements, which are designed to be brought into engagement with one another in the folded position, wherein at least one first closure element is arranged in the region of the lid and at least one second closure element is arranged in the region of a lower base edge of the further side walls.

Providing the closure means for fixing the transport container in the folded position has the advantageous effect that the surface sections folded or collapsed in the folded position, in particular the side walls and/or the lid, can also be kept in a compressed state against their own tension. The transport container therefore only requires a small amount of storage space in the folded position. In addition, dirt can be prevented from entering the transport container if it is closed via the closure means in the folded position. These measures advantageously promote the repeated use of the transport container, particularly in the field of transport or logistics.

In the folded position, the transport container does not hold any goods. The folded position is ideal for return transport by the parcel service provider and also for storage because the transport container requires little storage space in the folded position.

In one embodiment, the closure means is designed to close the lid in the unfolded transport position as well as in the folded position. The closure means is intended, in particular, to ensure that the loaded transport container is not opened unintentionally. Alternatively, an additional, separate closure means can also be provided for closing the lid. The closure means for closing the lid in the unfolded transport position and the closure means for fixing the transport container in the folded position can in principle be designed in different ways. In advantageous embodiments, the closure means for closing the lid in the unfolded transport position and the closure means for fixing the transport container in the folded position are designed in the same way. The releasable connection provided by the first and second closure elements is typically a positive or frictional connection, which can be provided by zippers, zip fasteners, snap fasteners or the like.

For fixing the transport container in the folded position in particular, at least one first closure element is arranged in the region of the lid and at least one second closure element is arranged in the region of the lower base edges of the further side walls. The mutually corresponding first and second closure elements provide a releasable fastening of the lid to the lower base edge, so that the transport container can be held in the folded position, in particular against its own tension.

In advantageous exemplary embodiments, in particular for releasably closing the lid in the unfolded transport position, at least one first closure element is arranged in the region of the lid and at least one further second closure element is arranged in the region of the upper edges of the further side walls. The mutually corresponding first and second closure elements provide a releasable attachment of the lid to the upper edges, which in particular form the upper edge of the loadable interior, so that unintentional opening of the transport container can be avoided and closure is ensured without the use of adhesive tape. Depending on the position of the transport container, the same first closure element can be fastened in the region of the lid with the second closure element in the region of the lower base edges or the further second closure element in the region of the upper edges.

The first closure element can extend over at least a section of an outer edge of the lid, wherein the second closure element corresponding to the first closure element extends over at least a corresponding section along the lower edges of the further side walls. Such an arrangement is advantageous because, in particular, forces which are caused by the rigidity of the side walls folded in the folded position and/or by the rigidity of the lid folded in the folded position can be distributed. This can, for example, prevent a local fastening point from tearing due to material fatigue or mechanical overload.

In possible embodiments, the first closure element extends circumferentially along the outer edge of the lid and the second closure element correspondingly extends circumferentially around the base. The space between the lid and the base, particularly when the transport container is in the folded position, is well shielded and protected from contamination by the circumferential closure means.

The first closure element can extend over at least a section of an outer edge of the lid, wherein the further second closure element corresponding to the first closure element extends over at least a corresponding section along the upper edges of the further side walls. Such an arrangement serves in particular to securely close a transport container that has been placed and loaded in the transport position.

Suitable closure means include, for example, zippers, zip fasteners, snap fasteners or the like. In particular, the first closure element and the second closure element or further second closure elements can be designed, for example, as correspondingly shaped toothed strips of a zipper.

In one embodiment, the pivot axis about which the lid can be pivoted with respect to the supporting side wall is predetermined by a fold line that the lid forms with the side wall. The fold line runs between a lower edge and an upper edge of the supporting side wall. In contrast to common transport packaging, crates, cartons or otherwise designed transport containers, it is therefore proposed that the pivot axis for the lid is not provided on an upper edge of the side wall carrying the lid, but rather at a point offset in the direction of the base or the lower edge. In this way it is ensured that the lid covers the base with the side walls folded in between with a precise fit and over a large area when the transport container is moved or arranged in the folded position. Edges of the side walls that protrude slightly in the folded position, for example due to their internal tension or limited flexibility, can be largely, preferably completely, covered by the lid and thus protected from damage. In addition, the transport container only takes up a small amount of storage space in the folded position.

In the context of this description, the term "lower edge" of the side wall refers to the edge of the corresponding side wall near the base. The "upper edge" refers to the edge of the corresponding side wall that is opposite the lower edge. The base with the side surfaces forms a lower edge running around the edge. The opposing upper edge forms the upper edge of the loadable interior and is particularly exposed in possible exemplary embodiments. Side surfaces of end-side side walls arranged opposite each other are typically the same size and, in embodiments, have the shape of a square or a rectangle, for example. In such configurations, the upper and lower edges of the side surfaces thus run parallel to one another.

The foldable transport container is preferably designed such that the four side walls can be pivoted with respect to the base over a relatively large angular range in order to enable the transport container to be folded into the folded position. In other words, each side wall is pivotably connected to the base, wherein the respective associated pivot axis runs along the lower edge of the respective side wall. In addition, the side walls can be pivoted towards one another, wherein the correspondingly assigned pivot axes run along lateral edges of the transport container. In the unfolded transport position, the side walls support each other in such a way that the side walls are prevented from pivoting about their lower edges and the transport container has a substantially rectangular and stable shape in the transport position. To move the transport container from the transport position into the folded position, for example, one or more side walls are first folded or collapsed by hand, so that the folded or collapsed side wall does not support the remaining side walls in a stabilizing manner and can also be folded. In particular, the folded side wall or the folded side walls are pulled down by the remaining side walls when moving them into the folded position.

The fold line, i.e. the articulation of the lid, can run parallel to the upper edge and/or parallel to the lower edge of the supporting side wall. It is preferable if the fold line runs in a direction parallel to the base surface predetermined by the base, so that the lid, in particular in the folded storage state, can extend in an essentially flat or curved manner over the base and the side surfaces folded between the base and the lid and so, for example, exposed edges can cover the folded side walls. In this way, damage can be avoided and contamination of the loadable interior, which is preferably predominantly, particularly preferably completely, covered by the lid in the folded position, can be prevented.

The fold line can run along the central longitudinal axis of the supporting side wall. In other words, the fold line extends along a straight line that is equidistant and parallel to the upper and lower edges of the supporting side wall. In embodiments, the central longitudinal axis divides the supporting side wall into two mutually congruent surface sections, which are folded when the transport container is moved into the folded position, so that they can preferably be placed flush on top of one another.

The lid can have a further fold line which runs parallel to the fold line. When opening and closing the transport container in the unfolded transport position, the lid is typically pivoted both about an angular range around the folding axis and about an angular range around the further folding axis.

In one embodiment, the further fold line can be brought into contact with the upper edge of the supporting side wall in the unfolded transport position. The further fold line can be brought into contact, preferably in direct contact, with the upper edge of the supporting side wall, for example by pivoting the lid about the pivot axis defined by the fold line. Since the lid is supported on the back by the upper edge of the supporting side wall along the further fold line in the closed, unfolded transport position, the stability of the transport container in particular is improved in the unfolded transport position.

The fold line and the further fold line can be arranged at a distance from one another which corresponds to half the distance between the upper and lower edges of the supporting side wall. For example, if the fold line between the supporting side wall and the lid extends along the central longitudinal axis of the supporting side wall, the surface section of the lid, which is formed between the fold line and the further fold line, can be essentially flush with the lower edge of the supporting side wall in the folded position and thus be brought essentially flush with the base of the transport container. The external dimensions of the transport container in the folded position are preferably determined by the size of the base. The folding described above prevents surface sections of the side walls and/or the lid that are folded in the storage state from protruding beyond the area of the base, so that damage is avoided and the transport container can be assigned a defined, preferably minimal, storage space requirement in the folded position.

In advantageous embodiments, the folding line and/or the further folding line are structurally designed in such a way that a pivoting movement about the pivoting axis specified by the respective fold line over an angular range is possible, in particular even with repeated use. When folding the transport container, flat sections of the supporting side wall and/or the lid are typically moved towards each other via pivoting about the respective pivot axis. It is advantageous if these flat sections lie as flat as possible on top of each other in the folded position in order to minimize storage space. For this purpose, it can be particularly advantageous to arrange the sections that are pivotably connected to one another on the fold line and/or on the further fold line at an angle that is as acute as possible, which can be limited, among other things, by the nature or flexibility of the materials used. The transport container preferably consists of sufficiently flexible material, for example of a suitable plastic, cardboard or a composite material, at least at the intended folds, fold edges or fold lines. In particular, surface sections of the transport container which have a substantially flat shape both in the transport position and in the folded position, can be accordingly reinforced, for example, by stiffening layers or coatings in order to increase the mechanical stability of the transport container. In embodiments, the base, the lid and/or the side walls have a coating or covering made of a fabric or a canvas. The covering can, for example, be heat-sealed, glued or sewn at least in regions to flat sections of the transport container.

The defined bending along the fold line and/or along the further fold line can be specified, for example, by the structural design of the transport container itself. In possible embodiments, the connection points of the lid with the supporting side wall, for example, specify the fold line between the supporting side wall and the lid. Alternatively or additionally, the fold line and/or the further fold line can be specified or supported by targeted material weakenings. For example, the course of the fold line and/or the further fold line can be specified by grooving or creasing in such a way that the side wall and/or the lid bends in a defined manner at these points under mechanical stress.

In one embodiment, two opposing end-side side surfaces are designed to be pressed in relative to one another in order to move the transport container from the unfolded transport position into the folded position. When transferring the transport container from the unfolded transport position to the folded position, the two opposing end-side side surfaces are typically folded inwards onto the base, so that the external dimensions of the transport container, in particular the height of the transport container, are significantly reduced in the folded position compared to the transport position. On the other hand, the base area of the transport container does not change. The side surfaces can be permanently connected to the base. This means that the side surfaces cannot be separated from the base and/or are firmly connected to the base. Side surfaces are understood to mean at least two side surfaces, preferably all side surfaces, of the transport container. The lid can be permanently connected to one of the side surfaces. In this case there is also an inseparable connection between the lid and the base.

An inseparable connection is a connection in which the components connected to each another cannot be separated from each other without destroying the connection. The side surfaces can be moved relative to the base so that the transport container can be brought into the folded position. However, the fixed connection between the, in particular at least two, preferably all, side surfaces and the base continues during the transfer of the transport container from the unfolded to the folded position or vice versa. A connecting edge between the respective lateral edge and the base can serve as a pivot axis for the respective side surface when the side surface is folded onto the base.

The two opposing end-side side surfaces can have material weakenings, for example in the form of grooves or creases, which provide defined fold edges when the transport container is moved from the unfolded transport position into the folded position. Particularly in the case of side walls with rectangular side surfaces, it is advisable, for example, to introduce material weakenings along a line that runs from a base corner of the side surface to the base or to the lower edge at an angle of approximately 45°.

The transport container described above is preferably used for transporting and/or storing objects, in particular packaged and/or bulk goods or other suitable cargo.

The invention is explained in more detail below using exemplary embodiments that are illustrated in the figures, wherein identical parts or, in particular, parts which correspond in terms of their function, are provided with the same reference numerals in all figures. The figures schematically show the following:

Figure 5:
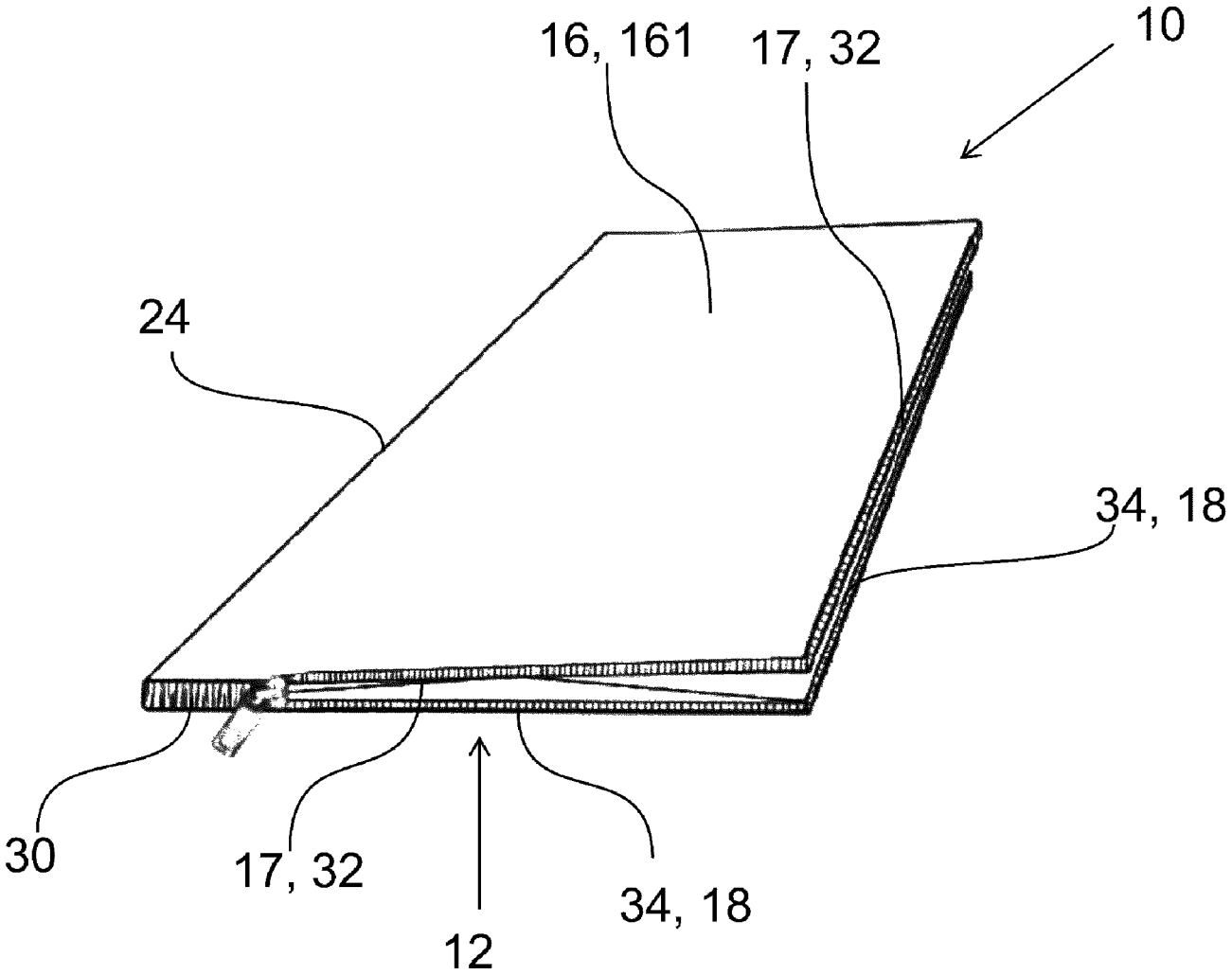

FIG. 5 the transport container in a folded position.

Figure 1:
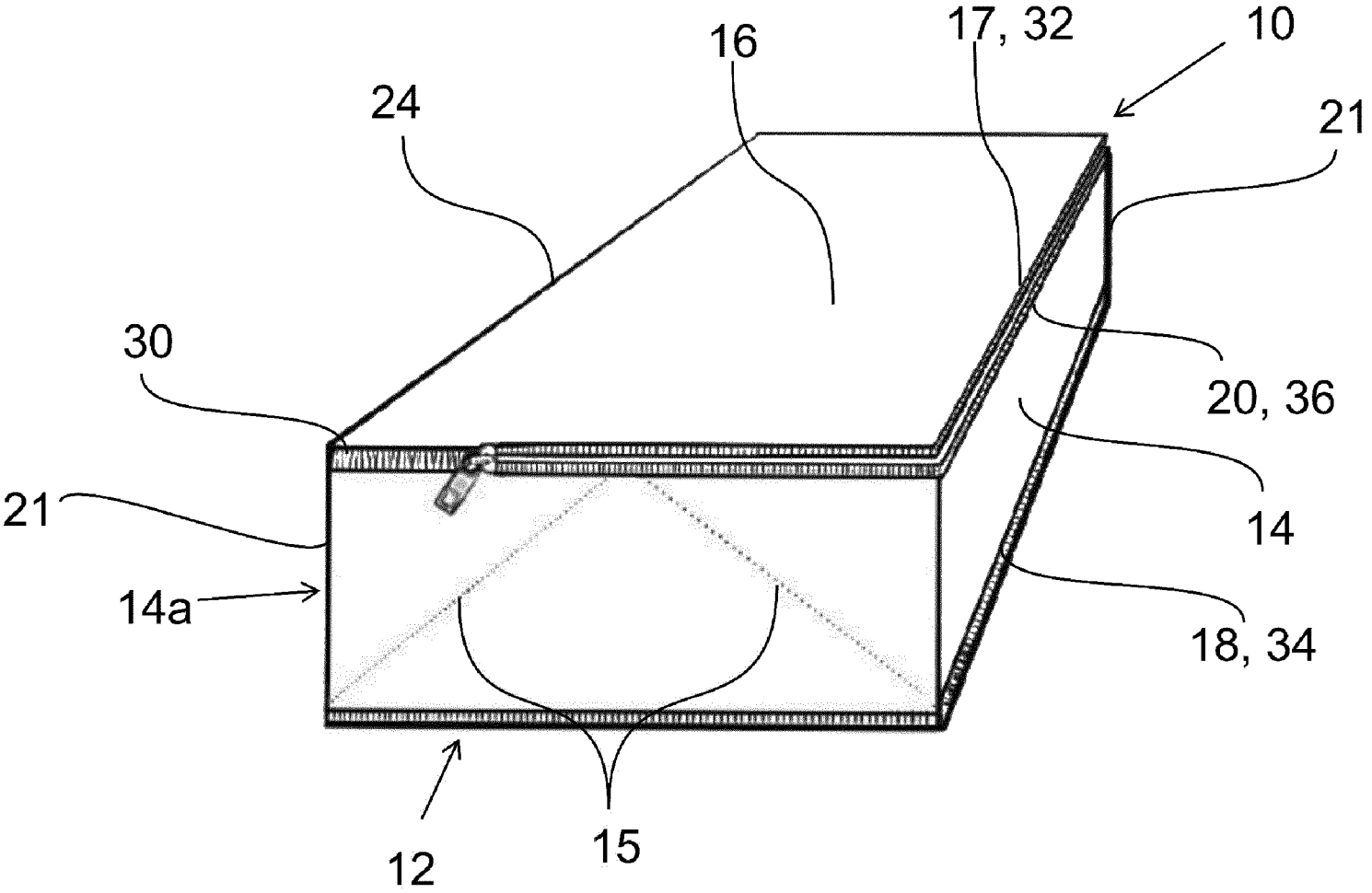
FIG. 1 shows a foldable transport container according to a possible exemplary embodiment of the invention in a closed, unfolded transport position.
Figure 2:
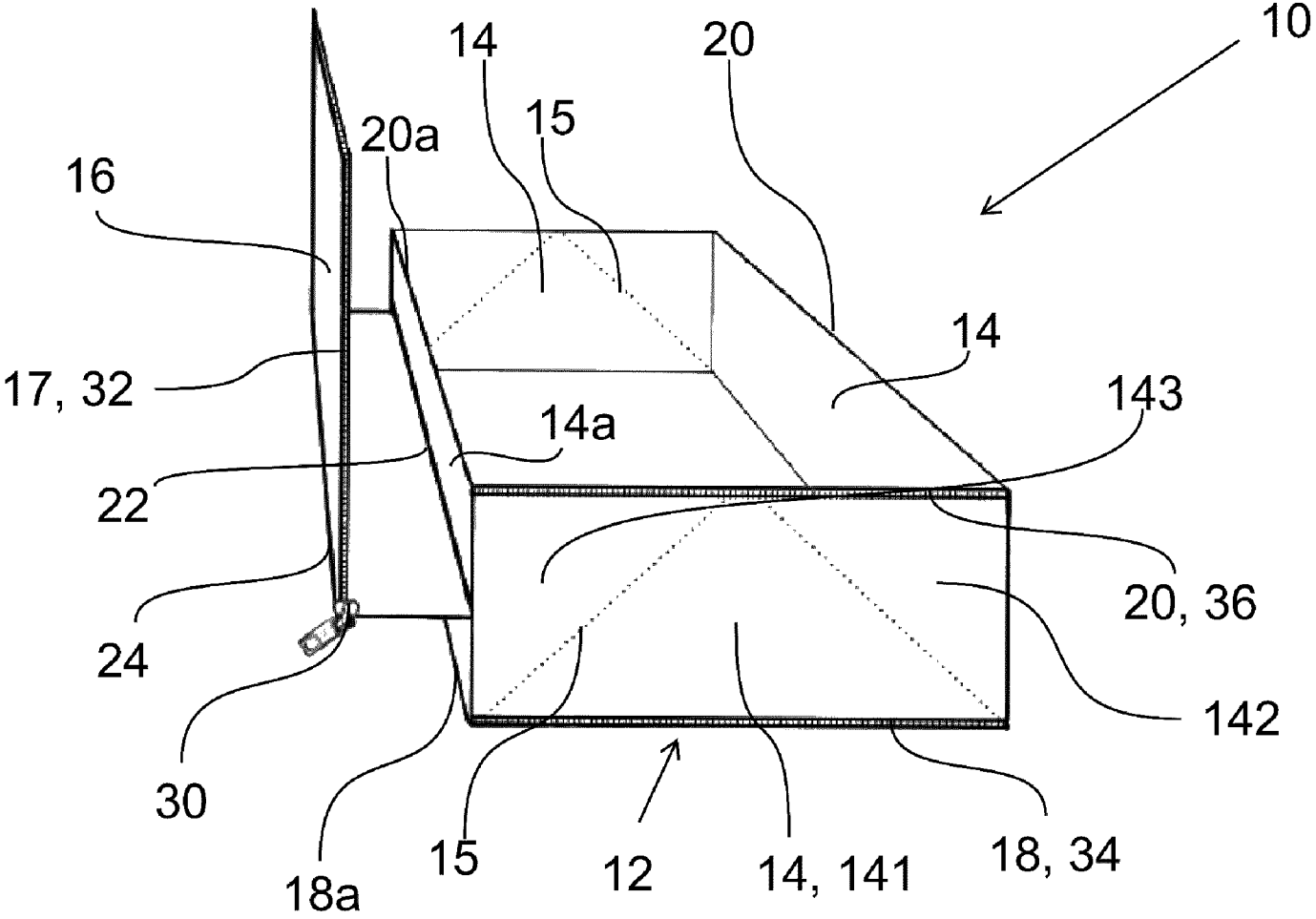
FIG. 2 shows the transport container in an open, unfolded transport position.
Figure 3:
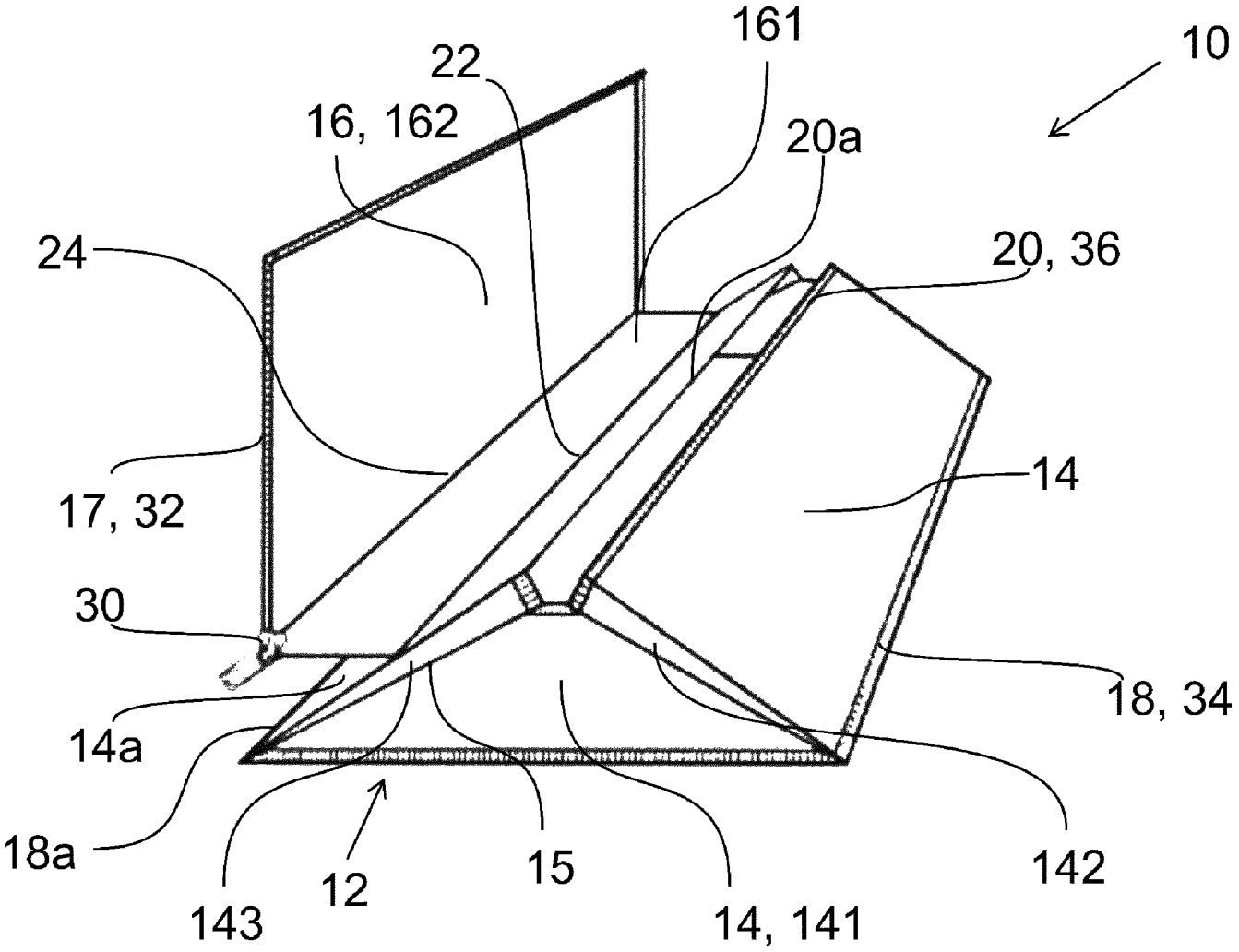
FIG. 3 shows the transport container in a partially folded intermediate position.
Figure 4:
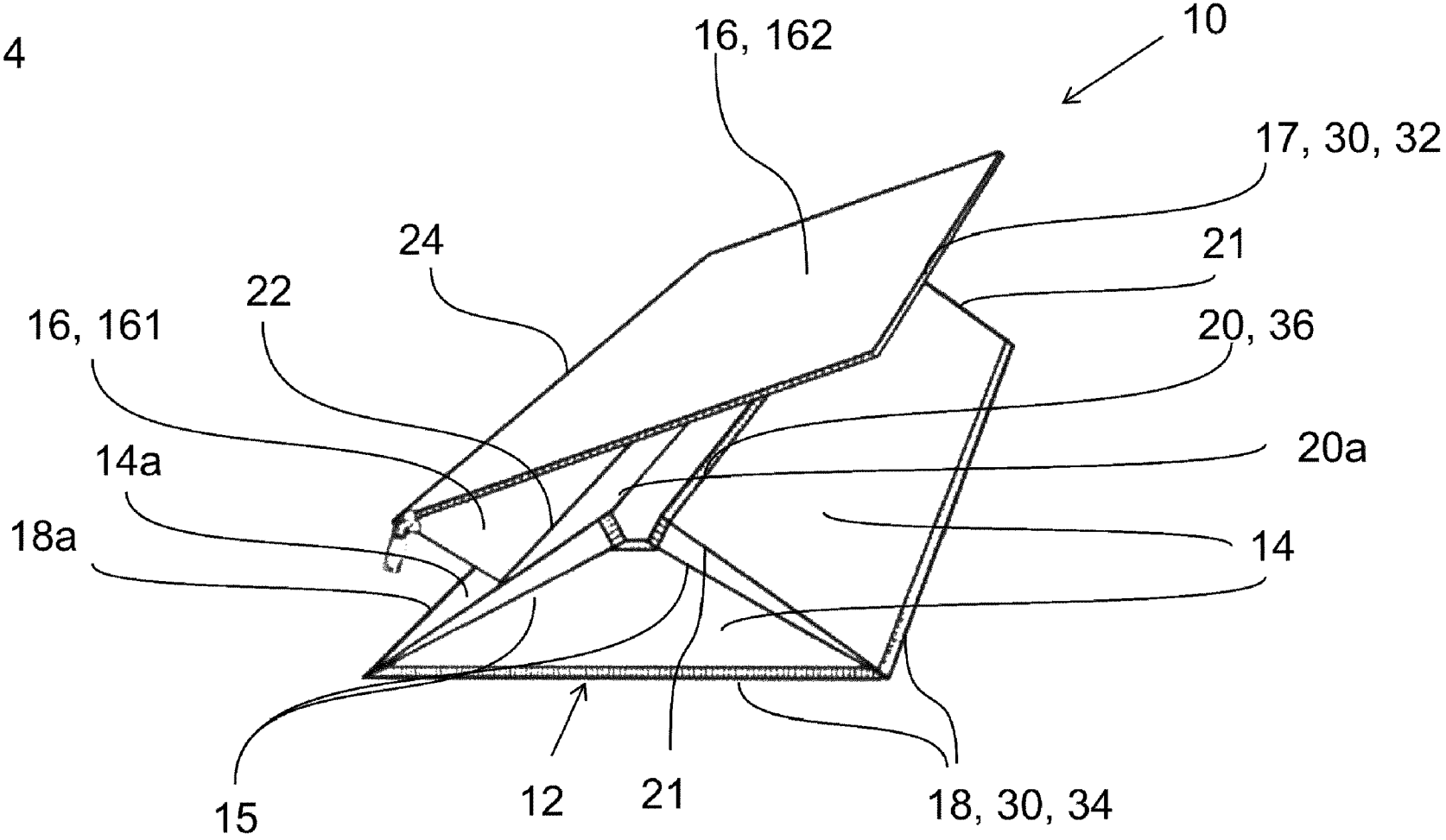
FIG. 4 shows the transport container in a further, partially folded intermediate position.

FIGS. 1 to 5 schematically show a foldable transport container 10 in different perspective views; the function of the folding in particular is illustrated in FIGS. 2 to 5, which enables moving or transferring the transport container 10 from an unfolded transport position shown in FIG. 2 into a folded position shown in FIG. 5.

In the essentially completely folded out and closed transport position of FIG. 1, the transport container 10 presents itself as a usual transport crate or transport box with a base 12 and four side walls 14, 14*a*, which delimit the loadable interior of the transport container 10 at the edges. The loadable interior can be closed by means of a pivotable lid 16, which can be brought into contact with the upper edges 20 of the side walls 14, 14*a* delimiting the interior in particular.

To close the lid 16, releasable closure means 30 are provided, which in the exemplary embodiment shown are designed as a zipper (also know as a zip or zip fastener). In alternative embodiments, other interlocking or engageable closure means 30 can also provide, in particular, a positive and/or non-positive fastening of the lid 16 to the side walls 14, for example with the aid of several snap buttons or the like.

The closure means 30 have, in particular, mutually corresponding first and second closure elements 32, 34, 36, which in the illustrated exemplary embodiment are designed in a manner known per se as strips that can be arranged opposite one another and have rows of teeth protruding on the edge and which can be brought into engagement with one another to provide a particularly positive fastening. The first closure element 32 is formed by a row of teeth which runs circumferentially around the lid 16 along an outer edge 17 of the lid 16. The second closure element 34 is designed to correspond to the first closure element 32 and extends circumferentially around the base 12 or along lower edges 18 of the side surfaces 14. A further second closure element 36 extends circumferentially along upper edges 20 of the side surfaces 14. In the exemplary embodiment shown, the mutually corresponding first and second closure elements 32, 34 form a zipper which serves to fix the transport container in the folded position (see FIG. 5 in particular).

In the exemplary embodiment shown, the mutually corresponding first and further second closure elements 32, 36 form a zipper, which is used in particular to close the lid 16 or to releasably fix the lid 16 to the side walls 14 (see FIG. 1 in particular).

As can be seen in particular in FIG. 2, the lid 16 is pivotably attached to a rear side wall 14*a* of the transport packaging 10, so that it can be pivoted about a pivot axis for opening and closing the transport packaging 10. This pivot axis is essentially determined by the connecting line of the lid 16 with the rear side wall 14*a*, which also defines a fold line 22.

During opening, closing or folding in and out the transport container 10, the lid 16 typically pivots about at least an angular range around the pivot axis predetermined by the fold line 22. In the exemplary embodiment shown, the fold line 22 runs along the central longitudinal axis of the essentially rectangular side wall 14*a* supporting the lid 16.

A further fold line 24 runs parallel to the fold line 22 and divides the lid 16 into two lid sections 161, 162 that can be pivoted towards one another. The further fold line 24 is predetermined, for example, by a targeted weakening of the material, such as a crease. During opening, closing or folding in and out of the transport container 10, the lid sections 161, 162 generally pivot relative to one another, as illustrated in particular in FIGS. 2 to 5.

The four side walls 14, 14*a* are pivotably connected to the base 12 about their respective lower edges 18, 18*a*. In addition, adjacent side walls 14, 14*a* can be pivoted relative to one another, wherein the associated pivot axes each run along the lateral edges 21. In the unfolded transport position, the side walls 14*a*, 14 support each other so that they run essentially perpendicular to the base 12.

The transport container 10 also has two side walls 14, which are arranged opposite each other at the end side and are designed in particular to be pressed in towards one another for transferring the transport container 10 from the transport position (FIG. 2) into the folded position (FIG. 5) and are thereby defined to fold. For this purpose, the two side walls have material weakenings 15, for example in the form of grooves, which divide the corresponding side surfaces, as shown in FIG. 2, into three approximately triangular surface sections 141, 142, 143.

When transferring the transport container 10 from the transport position into the folded position, the central surface sections 141 of the two further opposing end-side side walls 14 are folded inwards towards the base 12 (see in particular FIG. 3), so that they are substantially brought into planar contact with the base 12. The other two edge-side surface sections 142, 143 fold onto the central surface section 141 and thus substantially come into planar contact with the same. The supporting side wall 14*a* is tilted in the direction of the base 12 about a pivot axis running along the lower edge 18*a* and can thereby be substantially brought into planar contact with the folded surface sections 143. The side wall 14 opposite the supporting side wall 14*a* carries out a correspondingly opposite movement, so that it can be substantially brought into planar contact with the surface sections 142. The lid section 162 pivots about the fold line 22 in such a way that the further fold line 24 can be arranged essentially flush with the lower edge 18*a* of the supporting side wall 14*a*. The lid section 161 pivots about the further fold line 24 in order to be arranged essentially flush with the base 12, in particular in such a way that the side walls 14, 14*a* folded in between the base 12 and the cover 16 are preferably completely covered by the lid section 161.

In the folded position of FIG. 5, the side walls 14 are completely folded between the lid section 161 and the base 12, which are arranged essentially congruently opposite one another. To fix the transport container 10 in the folded position, it is provided in particular that the first closure element 32, which runs around the edge of the lid section 161, is brought into engagement with the second closure element 34, which runs around the edge of the base 12 along the lower edges 18.

REFERENCE CHARACTERS

10 Container
12 Base
14*a* Supporting side wall
14 Further side wall
141 Area section
142 Area section
143 Area section
15 Material Weakening
16 Lid
161 Lid section
162 Lid section
17 Outer edge
18 Lower edge (of the supporting side wall)
18 Lower edge
20*a* Upper edge (of the supporting side wall)
20 Upper edge
21 Lateral edge
22 Fold line
24 Further fold line
30 Closure means
32 First closure element
34 Second closure element
36 Further second closure element

The invention claimed is:

1. A foldable transport container, which can be moved between an unfolded transport position and a folded position, the foldable transport container comprising:

a base;

a lid;

a supporting side wall carrying the lid; and three further side walls (14);

wherein the lid is pivotably connected to the supporting side wall about a pivot axis;

wherein interlocking or engageable closures for fixing the transport container in the folded position have corresponding first and second closure elements, which are configured to be brought into engagement with one another in the folded position;

wherein at least one first closure element is arranged in a region of the lid and at least one second closure element is arranged in a region of a lower base edge of the further side walls;

wherein the pivot axis is predetermined by a fold line which the lid forms with the supporting side wall; and wherein the fold line runs between a lower edge and an upper edge of the supporting side wall.

2. The foldable transport container according to claim 1, wherein: the closures have mutually corresponding first and further second closure elements, which are configured to be brought into engagement with one another, in particular for closing the lid in the unfolded transport position, wherein at least one first closure element is arranged in a region of the lid and at least one further second closure element is arranged in a region of the upper edges of the further side surfaces.

3. The foldable transport container according to claim 2, wherein: the at least one first closure element extends over at least a section of an outer edge of the lid and the at least one further second closure element extends over at least a section along the upper edge.

4. The foldable transport container according to claim 1, wherein: the at least one first closure element extends over at least a section of an outer edge of the lid and the at least one second closure element extends over at least a section along the lower edge.

5. The foldable transport container according to claim 1, wherein the fold line is parallel to the upper edge of the supporting side wall and/or parallel to the lower edge of the side wall.

6. The foldable transport container according to claim 5, wherein the fold line is in a direction parallel to a base surface specified by the base.

7. The foldable transport container according to claim 1, wherein the fold line runs along a central longitudinal axis of the supporting side wall.

8. The foldable transport container according to claim 1, wherein the lid has a further fold line which runs parallel to the fold line.

9. The foldable transport container according to claim 8, wherein, in the unfolded transport position, the further fold line can be brought into contact with the upper edge of the supporting side wall.

10. The foldable transport container according to claim 9, wherein the further fold line can be brought into contact with the upper edge of the supporting side wall by pivoting the lid about the pivot axis.

11. The foldable transport container according to claim 8, wherein the fold line and the further fold line are arranged at a distance from one another which corresponds to half the distance from the upper edge of the supporting side wall to the lower edge of the side wall.

12. The foldable transport container according to claim 1, wherein two further opposing end-side side surfaces are configured to be pressed towards one another in order to move the transport container from the unfolded transport position into the folded position.

13. The foldable transport container according to claim 12, wherein the two further opposing end-side side surfaces have material weakenings which provide defined folding edges when the transport container is moved from the unfolded transport position to the folded position.

14. The foldable transport container according to claim 1, wherein, in the folded position, the lid is arranged essentially flush with the base.

* * * * *